US009687717B2

(12) United States Patent
Licata et al.

(10) Patent No.: US 9,687,717 B2
(45) Date of Patent: Jun. 27, 2017

(54) SPORTS SWING TRAINING APPARATUS

(71) Applicants: Michael Licata, Getzville, NY (US); Gary Roark, Evans, WV (US)

(72) Inventors: Michael Licata, Getzville, NY (US); Gary Roark, Evans, WV (US)

( * ) Notice: Subject to any disclaimer, the term of this patent is extended or adjusted under 35 U.S.C. 154(b) by 0 days.

(21) Appl. No.: 13/838,859

(22) Filed: Mar. 15, 2013

(65) Prior Publication Data

US 2014/0274435 A1 Sep. 18, 2014

(51) Int. Cl.
*A63B 69/36* (2006.01)

(52) U.S. Cl.
CPC ..... *A63B 69/3608* (2013.01); *A63B 2209/00* (2013.01)

(58) Field of Classification Search
CPC ..... A63B 69/36; A63B 53/00; A63B 55/08; A63B 69/3608; A63B 2209/00; G04B 37/14; E05D 7/04
USPC ..... 473/215, 216, 207, 266, 226, 257, 252, 473/272, 417, 477; 16/238, 245, 387; 280/47.27
See application file for complete search history.

(56) References Cited

U.S. PATENT DOCUMENTS 4,688,800 A * 8/1987 Lopez ..... 473/215
5,024,434 A * 6/1991 Smith ..... A63B 21/0724 482/106
5,050,885 A * 9/1991 Ballard et al. ..... 473/216
5,443,266 A * 8/1995 Bursi ..... 473/409
5,643,097 A * 7/1997 Bechler et al. ..... 473/215
5,879,240 A * 3/1999 Stuart ..... 473/215
6,130,861 A * 10/2000 Della Felice ..... 368/276
6,371,863 B1 * 4/2002 Moran ..... 473/207
6,428,421 B1 * 8/2002 Halfacre ..... 473/215
6,503,148 B2 * 1/2003 Lane ..... 473/215
6,582,318 B1 * 6/2003 Halfacre ..... 473/215
6,899,632 B2 * 5/2005 Lane ..... 473/215
7,431,661 B1 * 10/2008 Cailey ..... 473/257
8,157,665 B2 * 4/2012 Gibbs ..... 473/215
8,167,734 B2 * 5/2012 Boldin ..... 473/229
8,246,482 B1 * 8/2012 Kim ..... 473/272
8,376,751 B2 * 2/2013 Ranciato ..... 434/252
8,414,301 B2 * 4/2013 Dean et al. ..... 434/247
8,490,246 B2 * 7/2013 Waddell ..... 16/238
8,562,451 B2 * 10/2013 Crabtree ..... A63B 69/0059 473/215
8,613,677 B2 * 12/2013 Ramey et al. ..... 473/226
2004/0108668 A1 * 6/2004 Liu ..... 280/47.27
2007/0259764 A1 * 11/2007 Kelly ..... 482/904
2008/0085787 A1 * 4/2008 Molloy et al. ..... 473/417
2009/0042700 A1 * 2/2009 Liu ..... 482/107
2009/0156334 A1 * 6/2009 Cucchiara et al. ..... 473/477
2011/0201438 A1 * 8/2011 Butts ..... A63B 69/3608 473/215

* cited by examiner

*Primary Examiner* — Gene Kim
*Assistant Examiner* — Jeffrey Vanderveen
(74) *Attorney, Agent, or Firm* — Merek, Blackmon & Voorhees, LLC

(57) ABSTRACT

A sports swing training apparatus having a clip assembly for attaching the apparatus to an article of clothing of a user. Attached to the clip by a rod is a square shaped paddle arm. The paddle arm rotates about the rod in a forward or backward direction as a means for positioning the paddle arm.

7 Claims, 3 Drawing Sheets

SPORTS SWING TRAINING APPARATUS

CROSS REFERENCE TO RELATED APPLICATIONS

This application claims the benefit of U.S. Provisional application of Michal Licata and Gary Roark, Ser. No. 61/685,476, filed 19 Mar. 2012, having the title Sport Swing Training Device, which is incorporated herein by reference in its entirety.

FIELD OF THE DISCLOSURE

The present disclosure relates generally to golf and more particularly to a training apparatus or aid for golfers to help develop and/or correct the golfers swing by teaching the golfer the proper shifting of a golfer's legs and proper swaying of a golfer's hips.

BACKGROUND

Golf is a game of balance and skill where countless dollars have been spent by golfers in seeking professional lessons and expensive training apparatuses in an attempt to obtain a "perfect" swing. When the golfer swings, the golfer will shift their weight to their back leg during a backswing. It is during the backswing when typically a problem occurs. The typical problem is the golfer when shifting their weight will shift or lean their body in a way that tilts the golfer's rear leg or knee out of position. The problem continues during a forward or front swing, as the golfer typically is not able to correct for this improper tilt, thus resulting in the clubface being left too open on impact with a golf ball, which results in a slice.

Many attempts have been made to create an apparatus to help correct the golfer's balance and form. However, many of these apparatuses are heavy, require numerous adjustments for anatomical human body characteristics or are expensive. Also, many of these apparatuses are not capable of accommodating the different shapes and sizes of golfers. Lastly, most golfers cannot afford to take lessons from a personal instructor, and many that could, simply do not often have the time to do so.

Thus, a heretofore unaddressed need exists in the industry to address the aforementioned deficiencies and inadequacies.

SUMMARY

The present disclosure provides a sports swing training apparatus, which generally relates to golf training, but can be adapted to other sport applications requiring the user to perform a swinging motion such as baseball or other sports requiring the user to swing a racket, bat or appurtenance.

Briefly described, in one embodiment, is the sports swing training apparatus comprising a clip assembly for attaching the sports swing training apparatus to an article of clothing of a user; hingedly connected to a generally square shaped paddle arm by a rod, to allow the paddle arm to rotate about the rod in a forward and backward direction; and a means for positioning the paddle arm.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE EMBODIMENTS

Figure 1:
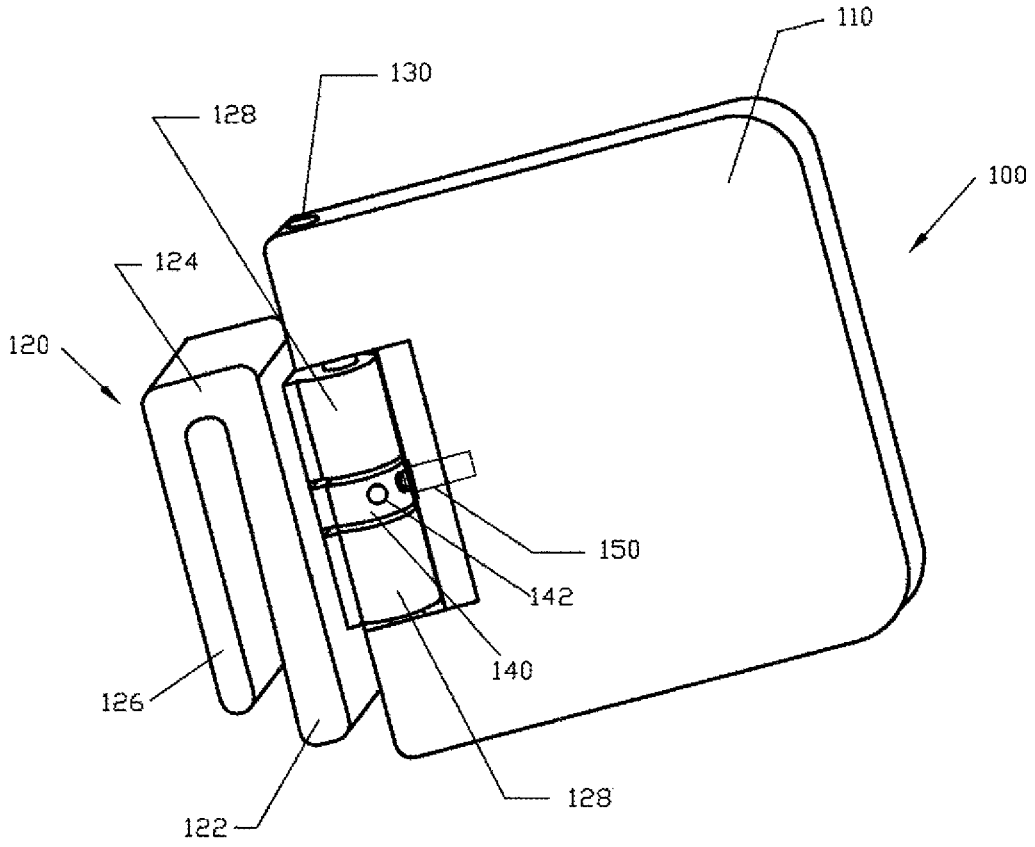
FIG. 1 illustrates a sport swing training apparatus.

Reference is now made in detail to the description of the embodiments as illustrated in the drawings. While several embodiments are described in the connection with these drawings, there is no intent to limit the disclosure to the embodiment or embodiments disclosed herein. On the contrary, the intent is to cover all alternatives, modifications, and equivalents.

It should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

Currently it is known that countless dollars have been spent by golfers and the like in seeking either professional lessons or with the purchasing of expensive golf training apparatuses, in the attempt of obtaining a "perfect golf swing." While many attempts have been made to create an apparatus, none have been successful in creating an apparatus that is inexpensive, lightweight and able to be used by golfers of all shapes and sizes, while also not requiring any adjustments for anatomical human body characteristics. Thus, there is a need for a sports swing training apparatus wherein the above deficiencies and other deficiencies in the prior art have been obviated in a novel manner by the present disclosure, as will be more apparent upon studying the remaining disclosure.

An embodiment of the present disclosure provides a sports swing training apparatus that is useful in developing a proper golf swing for golfers and the like of all levels of expertise from the beginner to the more advanced golfer. The sports swing training apparatus is of a geometric design that is attached to a golfer's belt or waistband by a clip assembly. The clip assembly is slipped onto the golfer's belt or waistband and positioned on or in close proximity of the golfer's rear hip. Due to the geometry, length and position of the sports swing training apparatus; the proper swing of the golfer must not come in contact with the sports swing training apparatus. If the golfer comes into contact with the sports swing training apparatus a paddle arm's position will be altered from its original predetermined position of zero degrees perpendicular to a golfer's hips to a new position of between zero to ninety degrees forward or backwards relevant to the zero degree mark. This movement of the paddle arm from its original position allows a golfer to realize that his or her golf swing was incorrect.

Figure 2:
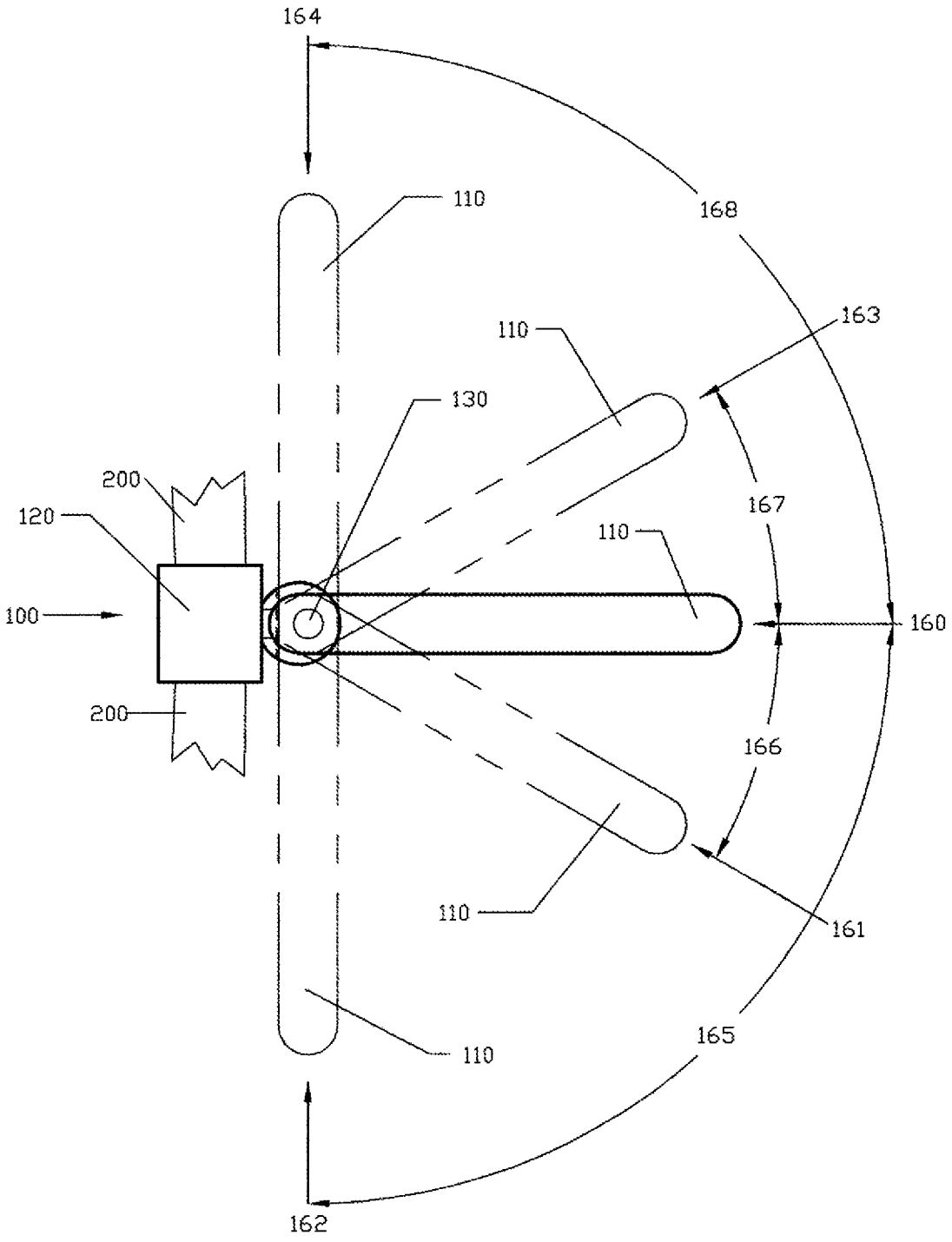
FIG. 2 illustrates an overhead view of a sports swing training apparatus displaying the sports swing training apparatus's overall motion.
Figure 3:
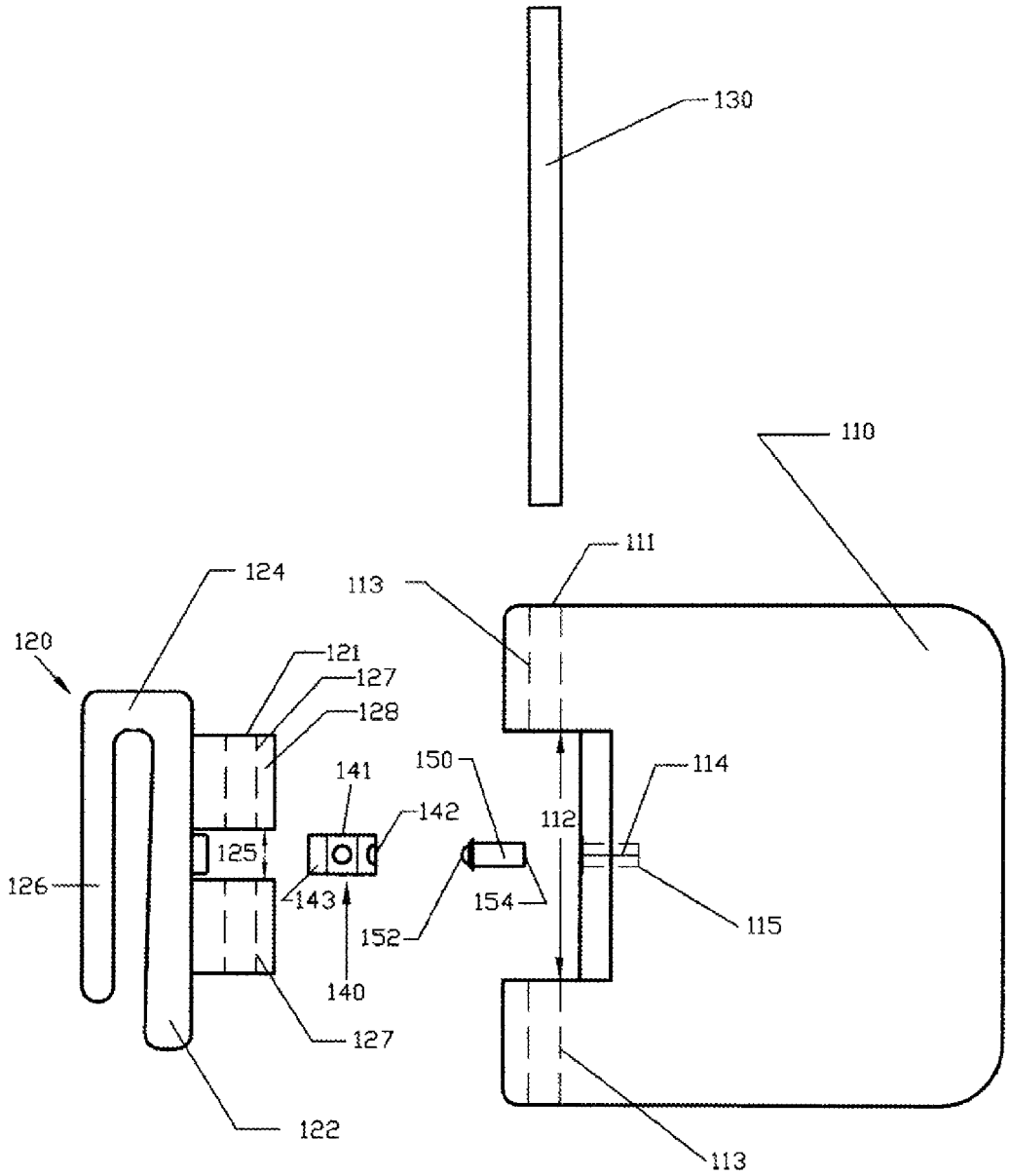
FIG. 3 illustrates an exploded view of a sports swing training apparatus.

Adverting now to the drawings, with reference to FIG. 1, is a sports swing training apparatus. The sports swing training apparatus is denoted by the number 100 and comprises of a paddle arm 110 with a spring-loaded dowel 150 which is operatively arranged to cooperate with a positioning ring 140 for positioning the paddle arm, a clip assembly 120, and a rod 130 Paddle arm 110 is hingedly connected to clip assembly 120 by rod 130 to allow paddle arm 110 to rotate about rod 130 in a forward and backward direction as shown in FIG. 2. Paddle arm 110 is generally square shaped with rounded corners and edges. Paddle arm 110 has a notch (as shown in FIG. 3) centrally located on one of the sides of paddle arm 110. The notch is capable of receiving clip assembly 120, rod 130 and positioning ring 140. Paddle arm 110 further comprises a hollow central channel extending longitudinally therethrough resulting in a paddle hole (as shown in FIG. 3). The paddle hole is located on the side with the notch, wherein the paddle hole is capable of receiving rod 130. The means for positioning paddle arm 110 is by spring-loaded dowel 150, which is positioned in a cavity centrally located within the notch of paddle arm 110. Spring-loaded dowel 150 has a domed end (as shown in FIG. 3), which allows spring-loaded dowel 150 to be operatively arranged to cooperate with positioning ring 140. Positioning ring 140 is cylindrical, with numerous indentations 142. Indentations 142 are concaved with a general spherical shape, allowing indentations 142 to receive the domed end of spring-loaded dowel 150, thus operatively arranging positioning ring 140 with spring-loaded dowel 150. Positioning ring 140 is connected to rod 130 by a ring hole (as shown in FIG. 3). The ring hole is a hollow central passage, which extends longitudinally therethrough positioning ring 140. Clip assembly 120 is capable of attaching to a golfer's article of clothing, wherein the article of clothing may be a belt or a waistband. Clip assembly 120 comprises a clip body 122 extending to a bend portion 124 and a clip arm 126 extending back along clip body 122 from bend portion 124. Clip body 122 includes cylindrical tubes 128 attached to clip body 122 with an opening (as shown in FIG. 3) between cylindrical tubes 128. The opening is capable of receiving positioning ring 140. Cylindrical tubes 128 have a hollow central shaft extending longitudinally therethrough resulting in a clip hole (as shown in FIG. 3). The clip hole is capable of receiving rod 130, which hingedly connects paddle arm 110 and positioning ring 140 with clip assembly 120.

FIG. 2 is an overhead view of the sports swing training apparatus displaying the sports swing training apparatus's overall motion. Rod 130 hingedly connects paddle arm 110 to clip assembly 120, thus allowing paddle arm 110 to rotate about rod 130 in a forward and backwards direction as indicated by arrows 168, 165, 167 and 166. The means for positioning paddle arm 110 is the spring-loaded dowel is positioned in the cavity centrally located within the notch of paddle arm 110 operatively arranged to cooperate with the positioning ring attached to rod 130. The positioning ring to cooperate with the spring-loaded dowel has indentations at set marks, which determines the position of paddle arm 110 when the golfer comes into contact with paddle arm 110. These indentations are located at the following: a predetermined zero degree mark or original position 160, where paddle arm 110 will be perpendicular to a golfer's hips; a negative thirty degree mark as indicated by position arrow 161; a negative ninety degree mark as indicated by position arrow 162; a positive thirty degree mark as indicated by position arrow 163; or a positive ninety degree mark as indicated by arrow 164. It should be noted that dash lines by position arrows 161, 162, 163 and 164 are to illustrate paddle arm 110 positions at those marks.

When sports swing training apparatus 100 is in use, clip assembly 120 is attached to golfer's belt or waistband 200 on or in close proximity of a golfer's rear hip. Paddle arm 110 will be perpendicular to the golfer's hips and thus have original position 160. Paddle arm 110 rotates from original position 160 if the golfer makes contact with paddle arm 110 during either a backswing or a front-swing. If the golfer makes contact with paddle arm 110 during the backswing, then paddle arm 110 will rotate from original position 160 to either negative thirty degrees position 161 or negative ninety degrees position 162. Paddle arm 110 at position arrows 161 and 162 is represented by dashed lines to illustrate paddle arm 110 positions. If the golfer hits paddle arm 110 during the front-swing then paddle arm 110 at original position 160 will rotate to either positive thirty degrees position 163 or positive ninety degrees position 164. Paddle arm 110 at position arrows 163 and 164 is represented by dashed lines to illustrate paddle arm 110 positions. If the golfer makes contact with paddle arm 110 during both the backswing and then the front-swing, paddle arm 110 may rotate to the positions of either 161, 160, 163 or 164 depending on the amount of force the golfer's contact is with paddle arm 110. It should be noted that movement of paddle arm 110 from original position 160 communicates to the golfer that his or her golf swing was incorrect. However if paddle arm 110 does not move from original position 160, during both the backswing and front-swing then the golfer has accomplished a "perfect" golf swing.

FIG. 3 is an exploded view of the sports swing training apparatus. Paddle arm 110 is generally square shaped with rounded corners and edges. Paddle arm 110 also has notch 112 centrally located on one of the sides of paddle arm 110. Notch 112 is capable of receiving clip assembly 120, positioning ring 140 and rod 130. Paddle arm 110 further comprises paddle hole 111, which is a hollow central passage extending longitudinally therethrough. Paddle hole 111 is represented by hidden lines 113 and is located on the side with notch 112. Paddle hole 111 is capable of receiving rod 130. Located centrally within notch 112 is cavity 114, which is represented by hidden lines 115. Cavity 114 is capable of receiving spring-loaded dowel 150. Spring-loaded dowel 150 has domed end 152 and an angular end 154. Angular end 154 is inserted in cavity 114, wherein angular end 154 becomes embedded with paddle arm 110. Domed end 152 is of a generally spherical shape and is capable of engaging with indentations 142 of positioning ring 140. Clip assembly 120 comprises clip body 122, which extends to bend portion 124 and clip arm 126, which extends back along clip body 122 from bend portion 124. Attached to clip body 122 are cylindrical tubes 128 with opening 125 located between cylindrical tubes 128. Opening 125 is capable of receiving positioning ring 140. Cylindrical tubes 128 have a hollow central shaft extending longitudinally therethrough resulting in clip hole 121 as represented by hidden lines 127. Clip hole 121 is capable of receiving rod 130. Positioning ring 140 is cylindrical, with numerous indentations 142, which are of a general concave shape capable of engaging with domed end 152 of spring-loaded dowel 150. Positioning ring 140 further comprises a hollow central passage, which extends longitudinally therethrough resulting in positioning ring hole 141 as represented by hidden lines 143. Positioning ring hole 141 allows positioning ring 140 to be attached to rod 130. Rod 130 is of a general cylindrical shape, which is capable of being inserted into paddle hole 111, clip hole 121 and positioning ring hole 141, thus hingedly connecting paddle arm 110 to clip assembly 120.

The sports swing training apparatus is constructed of but not limited to the following materials and designs:

The clip assembly is an injected molded plastic clip, designed to be affixed to a standard belt worn in standard belt loops of men or women's trousers. The clip assembly is also designed where it can be slipped over the waistband of standard men or women's trousers without the need for a standard belt. The clip assembly is also of a design such that the clip assembly will disconnect from the paddle arm by means of a mating snap hinge, mechanical connector, magnetic connector, VELCRO® or the like.

The paddle arm may be constructed of molded plastic, a man made polymer material or any material that is rigid to maintain shape and flexibility without departing from the present disclosure. The paddle arm has the general shape of a square with rounded corners and edges. However, the geometry of the paddle arm can be altered to meet the demands and needs of more specialized applications or altered for other sports training applications, such as, baseball or tennis. The paddle arm may also be designed and manufactured in such a manner as to be permanently affixed to the clip assembly or can be designed to be repositioned from the clip assembly by a connecting means such as using the rod as presently disclosed or by a mating snap hinge, mechanical connector, magnetic connector, VELCRO® or the like.

The rod is preferably constructed of stainless steel, but may also be constructed of aluminum alloy of similar mechanical properties, strength, and weight or plastic material of similar strength and weight or the like.

The positioning ring is preferably constructed of aluminum alloy but may also be constructed of stainless steel, machined or molded ABS plastic or a plastic family of similar mechanical properties or the like.

The spring-loaded dowel is preferably constructed of stainless steel, but may also be constructed of aluminum alloy of similar mechanical properties, strength, weight or can be any custom made or commercially available positioner.

Although exemplary embodiments have been shown and described, it will be clear to those of ordinary skill in the art that there are alternative ways that the sports swing training apparatus may be used and/or constructed. For example but not limited to, the geometry of the paddle arm can be altered to meet the demands and needs of more specialized applications or altered for other sports training applications, such as, baseball or tennis. Also, the paddle arm may also be designed and manufactured in such a manner as to be permanently affixed to the clip assembly. All such changes, modifications, and alterations should therefore be seen as within the scope of the disclosure.

What is claimed is:

1. A sports swing training apparatus comprising:

a clip assembly for attaching said sports swing training apparatus to an article of clothing of a user, said clip assembly being connected to a paddle arm by a rod to allow said paddle arm to rotate about said rod in a forward and backward direction; and a spring-loaded dowel positioned in a cavity centrally located within a cavity of said paddle arm and operatively arranged to cooperate with a positioning ring attached about said rod to selectively lock said paddle arm in a first preselected position;

said positioning ring having a plurality of indentations defining a plurality of locking positions about a circumference of said positioning ring for selectively locking said paddle arm in said indentations when said spring-loaded dowel is aligned with a one of said indentations;

wherein said spring-loaded dowel is configured to allow the paddle arm to lock selectively within one of the locking positions or pass through one or more of the locking positions in a manner dependent on a level of a force applied to the paddle arm by at least one of a user's arms during a swing.

2. The sports swing training apparatus of claim 1, wherein said positioning ring has indentions to receive a domed end of said spring-loaded dowel to lock said paddle arm in position relative to the clip assembly.

3. The sports swing training apparatus of claim 2, wherein said plurality of indentions on said circumference of said positioning ring are located at said first preselected position, at a second preselected position a negative thirty degrees relative to said first preselected position, a third preselected position a negative ninety degrees relative to said first preselected position, a forth preselected position a positive thirty degrees relative to said first preselected position, and a fifth preselected position a positive ninety degrees relative to said first preselected position along said positioning ring circumference for locking said paddle arm selectively in a one of said preselected positions relative to said clip assembly.

4. The sports swing training apparatus of claim 3, wherein a means for positioning said paddle arm is a spring-loaded dowel positioned in a cavity centrally located within a notch of said paddle arm operatively arranged to cooperate with a positioning ring attached to said rod;

wherein said paddle arm is tensioned to provide feedback on a user's swing after contact is made on said paddle arm by at least one of the user's arms;

wherein the paddle arm may selectively lock with said spring-loaded dowel within one of said plurality of indentations or pass through one or more of the plurality of indentations in a manner dependent on the force applied by at least one of the user's arms during a swing;

wherein said plurality of indentations on said circumference of said positioning ring are located at said first preselected position, at a second preselected position a negative thirty degrees relative to said first preselected position, a third preselected position a negative ninety degrees relative to said first preselected position, a fourth preselected position a positive thirty degrees relative to said first preselected position, and a fifth preselected position a positive ninety degrees relative to said first preselected position along said positioning ring circumference for locking said paddle arm selectively in one of said preselected positions relative to said assembly; and wherein after a correct swing by a user would cause both of user's arms to avoid contact with said paddle arm and said spring-loaded dowel is locked in said first preselected position at the end of the swing.

5. The sports swing training apparatus of claim 4, wherein said paddle arm has a length equal to its height.

6. A sports swing training apparatus comprising:

a clip assembly comprised of a clip body extending to a bend portion, a clip arm extending back along said clip body from said bend portion;

wherein said clip assembly is for attaching said sports swing training apparatus to a user, said clip being hingedly connected to a generally rectangular shaped paddle arm by a rod to allow sais paddle arm to rotate about said rod in a forward and backward direction;

a lock for affixing said paddle arm relative to said clip assembly selectively at several spaced apart locking positions along the travel of the paddle arm;

wherein said lock is a spring-loaded dowel positioned in a cavity located within said paddle arm operatively arranged to cooperate with a positioning ring attached to said rod to selectively lock said paddle arm relative to said clip assembly;

wherein said spring-loaded dowel is configured to allow the paddle arm to lock selectively within one of the locking positions or pass through one or more of the locking positions in a manner dependent on a level of force applied to the paddle arm by at least one of a user's arms during a swing;

a tensioning means for providing feedback on the user's swing after contact is made on said paddle arm by at least one of the user's swing after contact is made on said paddle arm by at least one of the user's arms, wherein said tensioning means is said spring loaded dowel; and wherein a length of the paddle arm is set minimally shorter than the length where a correct swing from the user would cause at least one of the said user's arms to contact said paddle arm to indicate when said paddle arm does not move relative to the clip assembly during a golf swing that the golf swing is successful.

7. A method of using a swing trainer comprising the steps of:

attaching said swing trainer to a user;

setting a paddle arm at a predetermined zero degree mark, where the paddle arm will be generally radially outward from the user;

performing a golf swing with at least one arm of the user passing the swing trainer; providing a lock for selectively locking the swing trainer in at least one of five predetermined positions; and determining a degree of incorrectness of the swing based upon the rotational distance traveled by the paddle arm to a final rotational position resulting from the contact of at least one of a user's arms with said paddle arm; wherein said final rotational position may be medial rotational position between a starting rotational position of said paddle arm and a terminal rotational position of said paddle arm; wherein said medial rotational position correlates with the degree of incorrectness of the swing;

wherein said paddle arm is selectively locked into position by a spring-loaded dowel configured to cooperate with a positioning ring; wherein said positioning ring has a plurality of indentions for receiving said-loaded dowel within the positioning ring; and wherein said spring-loaded dowel and is configured to allow the paddle arm to stop at one of the indentions or pass through one or more of the indentions in a manner dependent on a location on the paddle arm contacted by at least one of the user's arms during the swing.

* * * * *